US005406264A

United States Patent [19]

Plonsky et al.

[11] Patent Number: 5,406,264

[45] Date of Patent: Apr. 11, 1995

[54] GAMING CHIP WITH MAGNETIC EAS TARGET

[75] Inventors: Christopher B. Plonsky, Boca Raton; Thomas G. Riley, Boynton Beach, both of Fla.

[73] Assignee: Sensormatic Electronics Corporation, Deerfield Beach, Fla.

[21] Appl. No.: 229,169

[22] Filed: Apr. 18, 1994

[51] Int. Cl.[6] ..... G08B 13/187

[52] U.S. Cl. ..... 340/572; 40/27.5; 340/551

[58] Field of Search ..... 340/551, 572; 235/1 B, 235/1 R; 40/27.5

[56] References Cited

U.S. PATENT DOCUMENTS

| | | | |
|---|---|---|---|
| 4,075,618 | 2/1978 | Montean | 340/572 |
| 4,660,025 | 4/1987 | Humphrey | 340/572 |
| 4,859,991 | 8/1989 | Watkins et al. | 340/551 |
| 4,967,184 | 10/1990 | Regelsberger | 340/551 |

*Primary Examiner*—Glen Swann

*Attorney, Agent, or Firm*—Robin, Blecker, Daley & Driscoll

[57] ABSTRACT

A gaming chip has a disc-like body in which is disposed an amorphous magnetic marker material.

6 Claims, 1 Drawing Sheet

GAMING CHIP WITH MAGNETIC EAS TARGET

BACKGROUND OF THE INVENTION

This invention relates to a gaming chip, and, in particular to a gaming chip which is adapted to be detectable by an cronic article surveillance ("EAS") system so as to prevent unauthorized removal of the gaming chip from a casino or gambling establishment or certain areas therein.

Gaming chips used at various gambling establishments and casinos are generally circular in shape but vary in color, design characteristics and weight depending upon the value of the chip and casino where the chip is being used. A common problem associated with gaming chips is theft of the chips by employees of the casino or gambling establishment.

In a casino, gaming chips are used at various tables where games of chance, such as blackjack, roulette, etc. are being played. The area in which the table is located is known as a "gaming pit" or "pit". Employees who are working in the pit area have access to the gaming chips and may be tempted to "pocket" or steal gaming chips to be exchanged for money later.

U.S. Pat. No. 3,766,452 to Burpee et al. ("Burpee et al.") discloses one example of a gaming chip which is adapted to be detectable by an EAS system so as to deter the aforesaid stealing of gaming chips by employees. The chips of the Burpee et al. patent have a dielectric body with an inductive wire loop imbedded in the periphery of the chip and which terminates in a capacitive metallic bar. The inductive loop and capacitive bar cooperate with each other to provide a resonant electrical circuit. This resonant circuit responds to incident electromagnetic radiation at a preselected relatively high frequency to produce and radiate a unique detectable signal indicative of the presence of the chip in the incident field.

While the gaming chip of the '452 patent thus allows for detection of the chip so as to deter theft by employees, the need to use both a wire loop and metallic bar complicates the chip construction and results in relatively high production costs. As a result, alternative chip constructions are still being sought.

It is, therefore, an object of the present invention to provide a detectable gaming chip having a simple construction and a low production cost.

It is a further object of the present invention to provide a detectable gaming chip which is easily detectable by an EAS system.

SUMMARY OF THE INVENTION

In accordance with the principles of the present invention, the above and other objectives are realized in a gaming chip which includes a disc-like body in which is disposed an amorphous magnetic marker material so as to permit the gaming chip to be detectable by a magnetic EAS system.

In the illustrative form of the invention to be disclosed hereinafter, the disc-like body has top and bottom surfaces. The disc-like body also includes a centrally located aperture extending from the top surface to the bottom surface. The amorphous magnetic material is disposed in this aperture in surrounding relationship to a weighted member which identifies the denomination of the chip. A label covers the weighted member and the amorphous magnetic marker material and the disc-like body holds these elements to the disc-like body.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
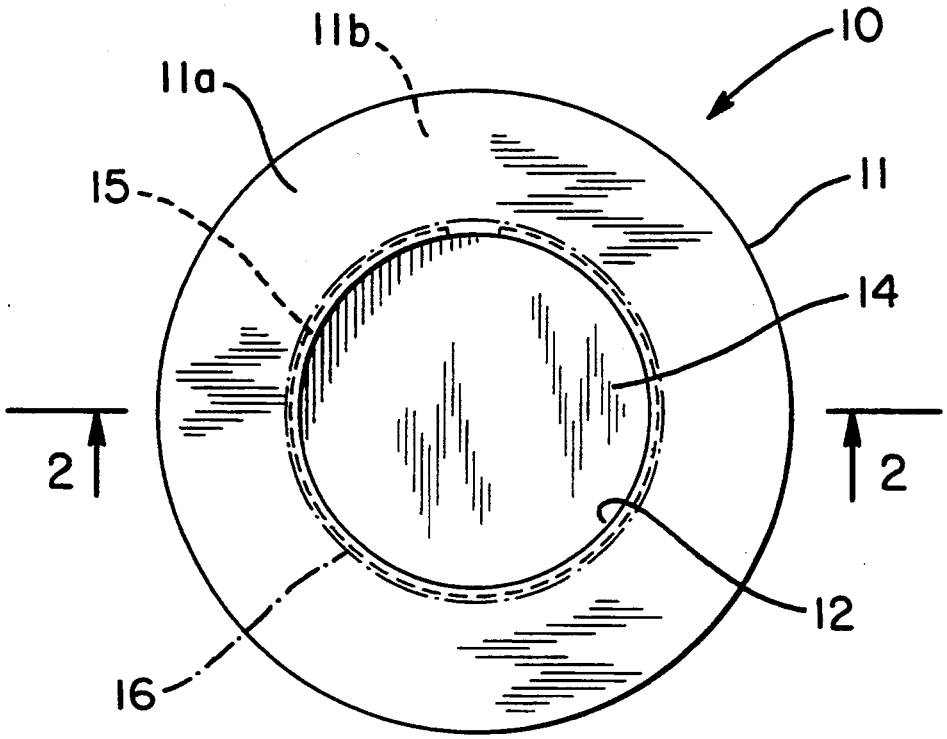
FIG. 1 shows a top view of a gaming chip in accordance with the principles of the present invention.
Figure 2:
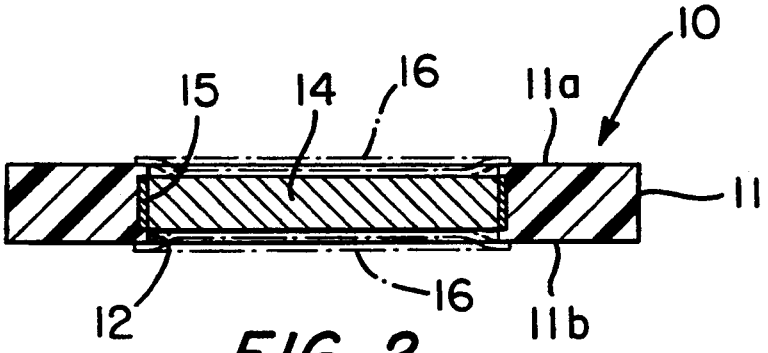
FIG. 2 shows a cross-sectional view of the gaming chip taken along the line 2—2 in FIG. 1.

FIGS. 1–2 show a gaming chip 10 in accordance with the principles of the present invention. As shown, the gaming chip 10 comprises a body 11 which is disc-shaped and is formed of a molded rigid plastic material. The body 11 has a top surface 11*a* and a bottom surface 11*b* and a centrally located aperture 12.

Within the aperture 12 is disposed a weighted member 14 used to denote the denomination of the chip. The weighted member 14 is securely affixed or attached to the body 11 during the molding operation used to fabricate the gaming chip 10. The weighted member is preferably metal, but other types of material can also be used.

In accordance with the principles of the present invention, an amorphous magnetic marker material 15 is disposed and secured within the aperture 12 and allows the chip 10 to be detected by a low frequency magnetic EAS system. The amorphous magnetic marker material may be of the type disclosed in U.S. Pat. No. 4,660,025 and the magnetic EAS system of the type disclosed in U.S. Pat. No. 4,859,991.

In the case shown, the marker 15 is arcuate or curved in shape and substantially encircles and weighted member 14 without forming a complete circle. The marker 15 is affixed to the body 11 also during the molding operation to fabricate the chip 10.

Labels 16 cover the weighted member 14 and the marker 15 and are securely affixed or molded to the top and bottom surfaces 11*a* and 11*b* of the body 11 of the gaming chip 10. The labels 16 hide the weighted member and marker from view so the presence of these elements is not readily apparent. One or both of the labels 16 may include identifying indicia printed thereon such as the casino designation, the chip denomination, serial number, date of issue, visual patterns, etc.

As above-indicated, the gaming chip 10 with the amorphous magnetic marker 15 disposed therein can now be detected by a magnetic EAS system. Accordingly, if an employee or other person pockets the chip 10 and passes through the magnetic EAS system, an alarm is sounded alerting security personnel to the presence of the chip and its unauthorized removal.

In all cases it is understood that the above-described configuration is merely illustrative of the many possible specific embodiments which represent applications of the present invention. Numerous and varied other configurations, can be readily devised in accordance with the principles of the present invention without departing from the spirit and scope of the invention. Thus, for example, the disc-like body 10, instead of being circular, as shown in FIGS. 1 and 2, can be square or any other type of shape.

What is claimed is:

1. A gaming chip comprising:

a disc-like body;

an amorphous magnetic marker material contained within said body; and a weighted member also contained within said body.

2. A gaming chip in accordance within claim 1, wherein:

said disc-like body has top and bottom surfaces, and a centrally located aperture extending from said top surface to said bottom surface;

said weighted member is disposed in said aperture, and said amorphous magnetic marker material is disposed in said aperture in surrounding relationship to said weighted member.

3. A gaming chip in accordance with claim 2, further comprising:

a label covering said weighted member and said amorphous magnetic marker material and affixed to a surface of said body.

4. A gaming chip in accordance with claim 3, wherein:

said disc-like body comprises plastic.

5. A gaming chip in accordance with claim 4, wherein:

said weighted member comprises metal.

6. A gaming chip in accordance with claim 3, wherein:

said label includes identifying indicia printed thereon.

* * * * *

UNITED STATES PATENT AND TRADEMARK OFFICE

CERTIFICATE OF CORRECTION

PATENT NO. : 5,406,264

DATED : April 11, 1995

INVENTOR(S) : Christopher B. Plonsky et al.

It is certified that error appears in the above-indentified patent and that said Letters Patent is hereby corrected as shown below:

Col. 1, line 8. Change "cronic" to -- electronic --.

Col. 2, line 37. Change "and" to -- the --.

Signed and Sealed this

Eleventh Day of July, 1995

*Attest:*

Bruce Lehman

BRUCE LEHMAN

*Attesting Officer*

*Commissioner of Patents and Trademarks*